US005853361A

United States Patent [19]

Kobayashi et al.

[11] Patent Number: 5,853,361

[45] Date of Patent: Dec. 29, 1998

[54] INCUBATOR

[75] Inventors: Shinichi Kobayashi, Tokyo; Kazunori Miyagawa, Kawagoe; Kazuo Matubara, Tokyo, all of Japan

[73] Assignee: Atom Medical Corporation, Tokyo, Japan

[21] Appl. No.: 835,439

[22] Filed: Apr. 9, 1997

[30] Foreign Application Priority Data

Apr. 19, 1996 [JP] Japan ..... 8-122178

[51] Int. Cl.[6] ..... A61G 11/00

[52] U.S. Cl. ..... 600/22; 600/21

[58] Field of Search ..... 600/21, 22; 5/421, 5/423, 97

[56] References Cited

U.S. PATENT DOCUMENTS 3,335,713 8/1967 Grosholz et al. ..... 600/22
4,936,824 6/1990 Koch et al. ..... 600/22
5,330,415 7/1994 Storti et al. ..... 600/22

*Primary Examiner*—John P. Lacyk
*Assistant Examiner*—Rosiland Kearney
*Attorney, Agent, or Firm*—Woodcock Washburn Kurtz Mackiewicz & Norris LLP

[57] ABSTRACT

When a temperature in a hood is not a preset temperature, or when the door of the hood is open, the air quantity of a blower is increased by a controller. A time required when a power switch is turned on until the interior of the hood reaches an atmosphere having the preset temperature is short. Even if a treatment for a baby's body in the hood is performed while the door is open, the atmosphere in the hood will not be disturbed easily. A time required when the treatment for the baby's body and the like are ended and the door is closed until the atmosphere in the hood is restored to the initial state is short. Accordingly, a time required when the power switch is turned on until the incubator is ready to use is short, and an adverse influence on the baby's body in the hood is reduced even after the treatment for the baby's body and the like are performed.

2 Claims, 3 Drawing Sheets

INCUBATOR

BACKGROUND OF THE INVENTION

1. Field of the Invention

The present invention relates to an incubator for housing a newborn baby or a premature baby in a hood and incubating the baby.

2. Description of the Prior Art

FIG. 1 shows a conventional incubator 11. This incubator 11 has a transparent hood 12 of a shape close to a rectangular parallelepiped. A plurality of hand windows 13 are formed in the side surfaces of the hood 12. The hand windows 13 have diaphragm mechanisms or the like that are opened when a baby's body (not shown) is treated by inserting the hands into the hood 12 therethrough.

An opening portion 14 is formed in one side surface of the hood 12. A transparent door 16 which pivots about hinges 15 as the center is attached to the opening portion 14. More specifically, if a sufficient treatment cannot be performed for the baby's body by only inserting the hands into the hood 12 through the hand windows 13, the door 16 is opened, and the treatment for the baby's body in the hood 12 is performed through the opening portion 14.

Air having a temperature, humidity, and the like that are controlled to be optimum for the baby's body is supplied into the hood 12 with a blower (not shown) at a constant air quantity. An air curtain as an air stream flowing upward along the opening portion 14 from its lower portion is formed so that, even if the door 16 is opened and the treatment for the baby's body in the hood 12 is performed through the opening portion 14 in the manner as described above, a change in atmosphere in the hood 12 is reduced and an adverse influence to the baby's body is decreased.

However, in the conventional example described above, since the quantity of air of the blower that supplies the air whose temperature and the like are controlled into the hood 12 is always constant. A time required when the power switch of the incubator 11 is turned on until the interior of the hood 12 reaches an atmosphere having a preset temperature and the like is long. If a treatment for the baby's body in the hood 12 is performed while the door 16 is open, the atmosphere in the hood 12 tends to be disturbed. A time required when the treatment for the baby's body and the like are ended and the door 16 is closed until the atmosphere in the hood 12 is restored to the initial state is long.

Therefore, a time required when the power switch of the incubator 11 is turned on until the incubator 11 is ready to use is long, and after a treatment for the baby's body and the like are performed, an adverse influence is given to the baby's body in the hood 12.

OBJECT AND SUMMARY OF THE INVENTION

It is, therefore, an object of the present invention to provide an incubator in which a time required when a power switch is turned on until the incubator becomes ready to use is short and even after a treatment for the baby's body and the like are performed, the baby's body in the hood is not adversely affected.

An incubator according to the present invention is characterized by comprising a hood formed with a door, a temperature detector for detecting a temperature in the hood, a door open detector for detecting an open state of the door, a blower for supplying an air having a controlled temperature into the hood, and a controller for increasing an air quantity of the blower when the temperature detector detects that the temperature in the hood is not a preset temperature or when the door open detector detects that the door is open.

In this manner, when the temperature in the hood is not the preset temperature, or when the door of the hood is open, the air quantity of the blower is increased. Thus, a time required when the power switch is turned on until the interior of the hood reaches an atmosphere having the preset temperature is short. Even if a treatment for the baby's body in the hood is performed while the door is open, the atmosphere in the hood will not be disturbed easily. A time required when the treatment for the baby's body and the like are ended and the door is closed until the atmosphere in the hood is restored to the initial state is short. Accordingly, a time required when the power switch is turned on until the incubator is ready to use is short, and an adverse influence on the baby's body in the hood is reduced even after the treatment for the baby's body and the like are performed.

The incubator according to the present invention preferably comprises an opening portion which is formed in a side surface of the hood and to which the door is attached, a baby's body rest table which is movable between an inside and an outside of the hood through the opening portion whose door is open, and air curtain forming means for injecting an air stream flowing downward along the opening portion from its upper portion.

With this arrangement, even when the door is open and the baby's body rest table is pulled out midway to the outside of the hood in order to perform a treatment for the baby's body and the like, formation of the air curtain at the opening portion is not interfered with. In addition, the air quantity of the blower is large. Therefore, a change in atmosphere in the hood is small, and a time required when the treatment for the baby's body and the like are ended and the door is closed until the atmosphere in the hood is restored to the initial state is short.

A treatment for the baby's body and the like can be performed while the door is open and the rest table is pulled out midway to the outside of the hood. A time required when the door is closed until the atmosphere in the hood is restored to the initial state is short. Although the treatment for the baby's body and the like can be performed easily, an adverse influence on the baby's body in the hood is reduced even after the treatment for the baby's body and the like are performed.

BRIEF DESCRIPTION OF THE DRAWINGS

FIGS. 2A and 2B are side sectional views of an embodiment of the present invention, in which FIG. 2A shows a state wherein the door is kept closed, and FIG. 2B shows a state wherein the door is open.

DETAILED DESCRIPTION OF THE PREFERRED EMBODIMENT

Figure 1:
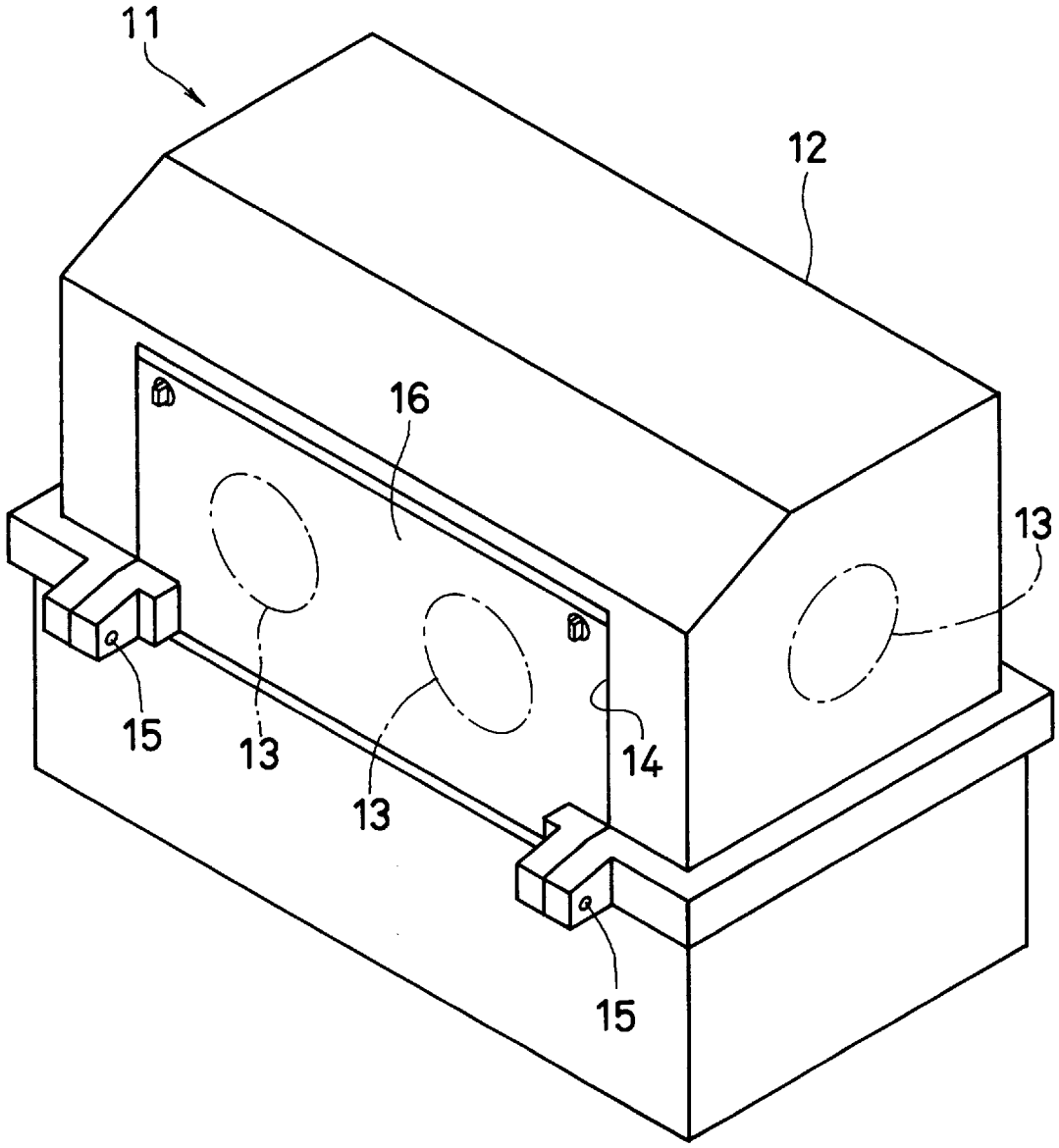
FIG. 1 PRIOR ART
FIG. 1 is a perspective view of a conventional incubator concerning the present invention.
Figure 2A:
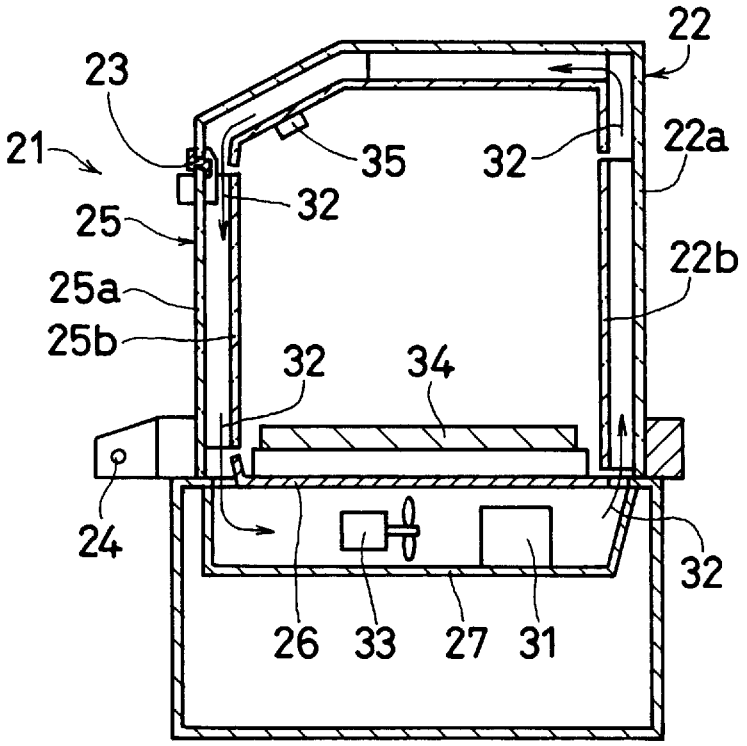
Figure 2B:
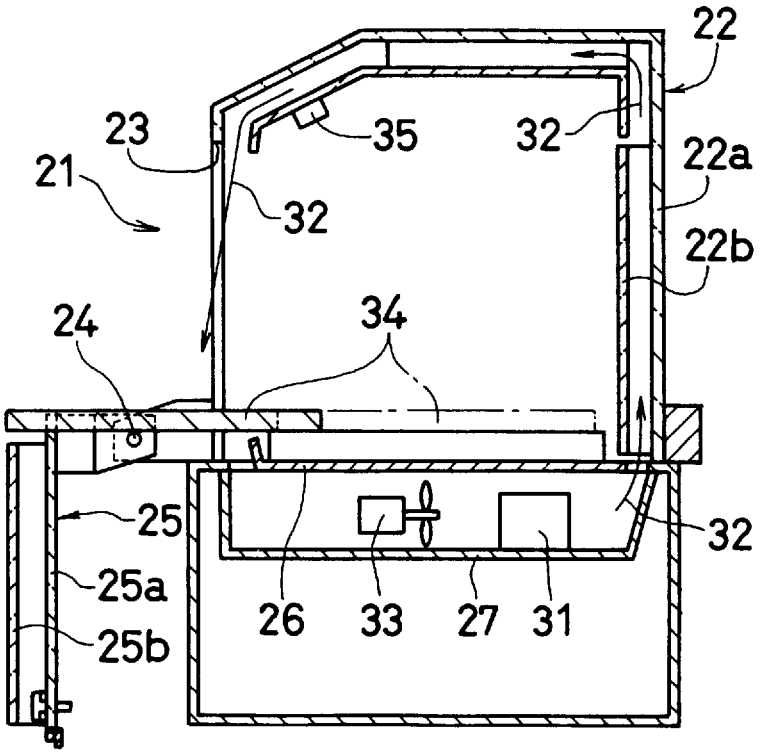

An embodiment of the present invention will be described below with reference to FIGS. 2A and 2B, and FIG. 3. As shown in FIGS. 2A and 2B, an incubator 21 of this embodiment also has a transparent hood 22 whose outer wall 22*a* has a shape close to a rectangular parallelepiped. An opening portion 23 is formed in one side surface of the hood 22, and a door 25 which pivots about hinges 24 as the center is attached to the opening portion 23.

Transparent inner walls 22*b* are formed on a wall surface, of the hood 22, other than those on the sides of the head and feet of the housed baby's body, to oppose the outer wall 22*a* and to be separated from the outer wall 22*a* by a predetermined distance. A transparent outer wall 25*a* and a transparent inner wall 25*b* are formed on the door 25 as well. At a position away downward by a predetermined distance from a bottom surface 26 in the incubator 21 covered with the hood 22, another bottom surface 27 is formed.

Except for the surfaces on the head and feet sides of the housed baby's body, the wall surfaces form a double structure on any of the four surfaces, and spaces in the double-structure wall surfaces communicate with each other. A controller 31 for controlling the air temperature, humidity, and the like to preset values, and a blower 33 for blowing a controlled air in the direction of an arrow 32 are arranged between the bottom surfaces 26 and 27.

A rest table 34 for the baby's body is formed on the bottom surface 26 in the incubator 21 covered with the hood 22. As shown in FIGS. 2A and 2B, this rest table 34 is movable between the inside and outside of the hood 22 through the opening portion 23 whose door 25 is open.

A temperature detector 35 for detecting the temperature in the hood 22, and a door open detector (not shown) for detecting that the door 25 is open are arranged. If the temperature detector 35 detects that the temperature is not the pre set temperature, or if the door open detector detects that the door 25 is open, the controller 31 increases the air quantity of the blower 33. Hand windows (not shown) are formed to extend through the outer and inner walls 22*a* and 22*b* of the hood 22, and the outer and inner walls 25*a* and 25*b* of the door 25.

Figure 3:
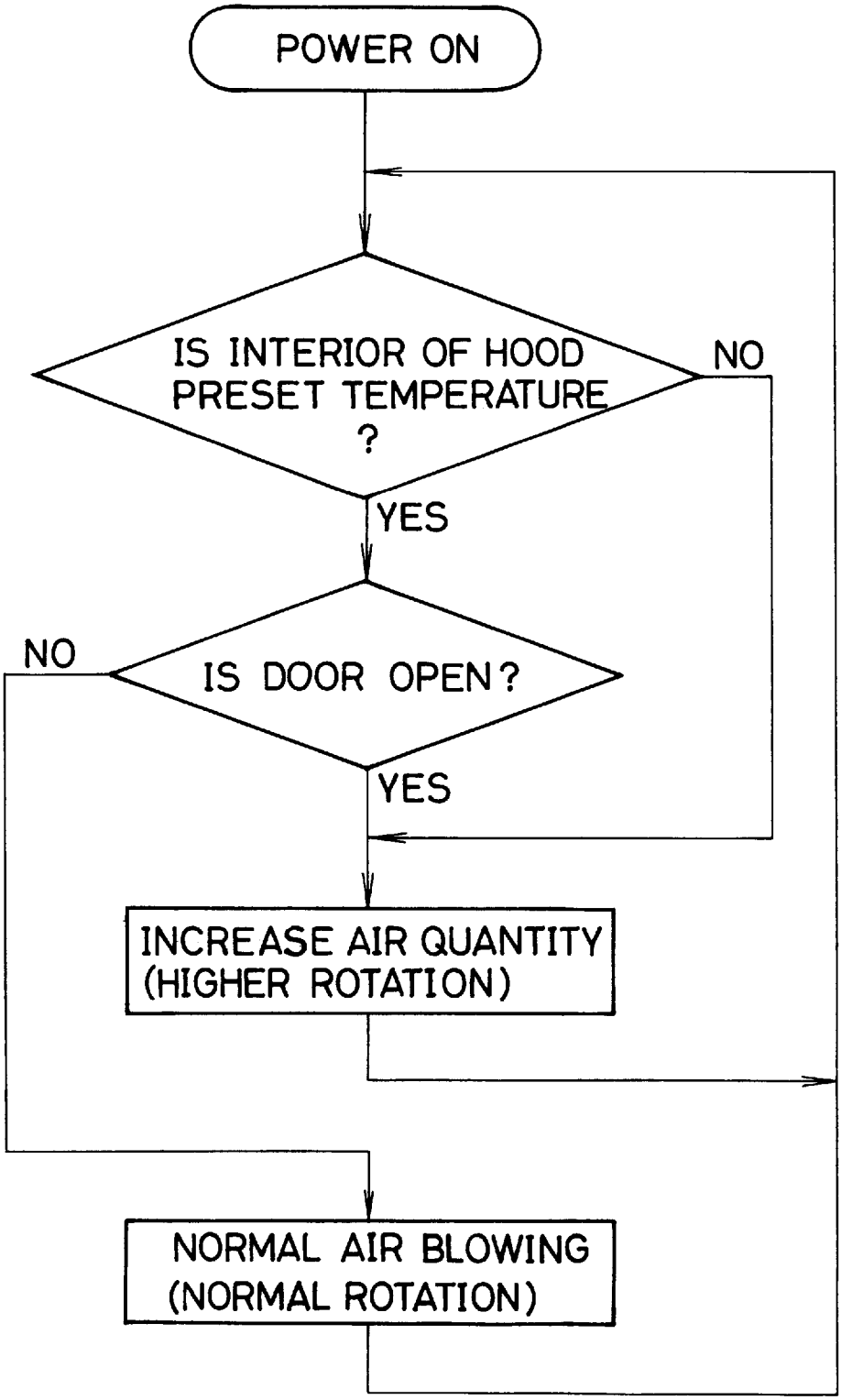
FIG. 3 is a flow chart showing the operation of the embodiment of the present invention.

In the above embodiment, as shown in FIG. 3, when the power switch of the incubator 21 is turned on, the temperature detector 35 detects the temperature in the hood 22. If the detected temperature is not the preset temperature, the controller 31 rotates the blower 33 at a rotation speed higher than that in the normal state, thereby increasing the air quantity per unit time to be larger than that in the normal state.

If the door 25 is closed, as shown in FIG. 2A, air whose temperature, humidity, and the like are controlled to desired values circulates between the wall surfaces having the double structure on the four surfaces other than the surfaces of the head and feet sides of the housed baby's body.

Since the temperature of the air supplied by the blower 33 is controlled to the preset value, if the air quantity per unit time is large, a large quantity of heat propagates per unit time. For this reason, for example, if the temperature in the hood 22 is less than the preset temperature, the interior of the hood 22 is heated quickly; if it exceeds the preset temperature, the interior of the hood 22 is cooled quickly.

When the temperature in the hood 22 detected by the temperature detector 35 reaches the preset temperature, the controller 31 decreases the rotation speed of the blower 33 to that in the normal state to decrease the air quantity per unit time to that in the normal state. After this, the controller 31 continues the operation in this normal state.

As shown in FIG. 2B, if the door 25 is open to allow the treatment for the baby's body in the hood 22 and the like, even if the temperature in the hood 22 detected by the temperature detector 35 is the preset temperature, the controller 31 rotates the blower 33 at a rotation speed higher than that in the normal state, as shown in FIG. 3, thereby increasing the air quantity per unit time to be larger than that in the normal state.

As a result, the atmosphere in the hood 22 will not be disturbed easily. Even if the atmosphere in the hood 22 should be disturbed, the degree of this disturbance is very small. After the treatment for the baby's body and the like are ended, when the door 25 is closed, the atmosphere in the hood 22 is restored to the initial state quickly. In particular, if only the door 25 is open, since air circulates with the air stream flowing downward along the opening portion 23 from its upper portion, the atmosphere in the hood 22 will not be particularly disturbed easily.

In contrast to this, as is apparent from FIG. 2B, while the door 25 is open and the rest table 34 is pulled out midway to the outside of the hood 22 in order to allow a treatment for the baby's body laid on the rest table 34 and housed in the incubator 21, the air circulation path is blocked by the rest table 34 in the lower portion of the opening portion 23, and the air does not circulate.

However, the air stream flowing downward along the opening portion 23 from its upper portion is kept injected to form the air curtain, and the air stream is also supplied to the baby's body on the rest table 34. In addition, the quantity of air per unit time is larger than in the normal state. Therefore, changes in an atmosphere in the hood and in an atmosphere for the baby's body under treatment are small to decrease an adverse influence on the baby's body.

What is claimed is:

1. An incubator characterized by comprising:

a hood formed with a door;

a temperature detector for detecting a temperature in said hood, said temperature detector outputting a temperature signal indicative of said temperature;

a door open detector for detecting an open state of said door, said door open detector outputting a signal indicative of said open state;

a blower for supplying an air having a controlled temperature into said hood; and a controller having a temperature signal input in communication with said temperature detector output and a door open signal input in communication with said door open detector, said controller in communication with said blower such that said controller increases an air quantity of said blower when said temperature detector detects that the temperature in said hood is not a preset temperature or when said door open detector detects that said door is open.

2. An incubator according to claim 1, characterized by comprising:

an opening portion which is formed in a side surface of said hood and to which said door is attached;

a baby's body rest table which is movable between an inside and an outside of said hood, said baby's body rest table being movable through said opening portion when said door is open; and air curtain forming means for injecting an air stream flowing downward along said opening portion from its upper portion.

* * * * *